United States Patent [19]

Maruyama et al.

[11] 3,935,335

[45] Jan. 27, 1976

[54] METHOD FOR PRODUCING SUPPORT FOR ELECTROPHOTOGRAPHIC MATERIAL AND ELECTROSTATIC RECORDING MATERIAL

[75] Inventors: Isamu Maruyama; Shigeyoshi Suzuki, both of Nagaokakyo; Yoshitake Yoshihiro, Tokyo, all of Japan

[73] Assignee: Mitsubishi Paper Mills, Ltd., Japan

[22] Filed: Apr. 10, 1974

[21] Appl. No.: 459,789

[30] Foreign Application Priority Data

Apr. 26, 1973 Japan ..... 48-46688

[52] U.S. Cl. ..... 427/121; 427/439

[51] Int. Cl.[2] ..... B05D 5/12

[58] Field of Search ..... 117/155 UA; 117/215; DIG 4, 427/121, 439

[56] References Cited

UNITED STATES PATENTS

| | | | |
|---|---|---|---|
| 3,216,853 | 11/1965 | Gess | 117/155 UA |
| 3,261,798 | 7/1966 | Farley | 117/155 UA |
| 3,264,137 | 8/1966 | Gess | 117/155 UA |
| 3,493,369 | 2/1970 | Busch et al. | 117/155 UA |
| 3,511,798 | 5/1970 | Isaacson et al. | 117/155 UA |

*Primary Examiner*—Cameron K. Weiffenbach
*Attorney, Agent, or Firm*—Cushman, Darby & Cushman

[57] ABSTRACT

A support for electrophotographic material and electrostatic recording material which is improved in solvent resistance and electroconductivity can be produced by firstly fixing an anionic sizing agent into an untreated paper and then fixing a cationic high polymer electroconducting agent into thus treated paper or coating the same thereon. Preferably, the first step is carried out by size pressing.

14 Claims, No Drawings

METHOD FOR PRODUCING SUPPORT FOR ELECTROPHOTOGRAPHIC MATERIAL AND ELECTROSTATIC RECORDING MATERIAL

BACKGROUND OF THE INVENTION

The present invention relates to a method for producing a support for electrophotographic material or for electrostatic recording material which is light in weight and excellent in solvent resistance and electroconductivity.

Main characteristics with a support for electrophotographic material or for electrostatic recording material (this is referred to as a base paper hereinafter) should possess are as follows:

1. It must be excellent in solvent resistance.
2. It must have a good electroconductivity.
3. It must not have adverse effect on electrophotographic layer or electrostatic recording layer.

The property of the above (1) is required for preventing permeation of solvent into a base paper to make the coated film homogeneous because organic solvents such as toluene, xylene, etc., are often used for coating of a recording layer. The property of the above (2) is required for sufficient charging and discharging of a recording layer to obtain excellent image.

In order to obtain the above properties (1) and (2), conventionally, natural or artificial viscous adhesives have been used as a permeation preventing agent and one or more of inorganic salts and polyhydric alcohols such as sodium chloride, calcium chloride, iron chloride, etc., and ethylene glycol, glycerine, sorbitol, etc., have been used as an electroconducting agent (See Japanese Pat. No. 29316/64). However, according to such method, there have been such defects as a high dependency of electroconductivity on humidity, low preservability of recording paper caused by use of inorganic salts, etc. There have been proposed a method for improving electroconductivity and preservability by combination of a cationic antistatic agent comprising a quaternary ammonium salt of a polymer and an anionic active agent having hydrophilic group (Japanese Pat. No. 19195/69). However, according to said method, although electroconductivity and preservability can be improved, solvent resistance is not improved. For imparting both electroconductivity and solvent resistance, there has been a method which comprises impregnating or coating paper with an aqueous solution of a mixture of a highly saponified styrene/maleic anhydride copolymer of high polymerization degree and a highly saponified styrene/maleic anhydride copolymer of low polymerization degree or said mixture to which a natural or synthetic sizing agent is added (see Japanese Pat. No. 13166/71). However, according to this method, there is the possibility of quality of image lowering due to shortage in electroconductivity at low humidity in both cases of using only styrene/maleic anhydride copolymers different in polymerization degree and saponification degree and using said copolymers to which glue-like silica, fine grain silica and water soluble polyethylene glycol are added.

Therefore, in order to safisfy said requirements for base paper by these conventionally proposed methods, it has been necessary to apply the treating materials in a considerably large amount to a support.

SUMMARY OF THE INVENTION

The purpose of the present invention is to overcome the difficulties in the conventional methods. That is, by the present invention, electroconductivity and solvent resistance of base paper are improved and it is more important that this purpose can be attained by application of the materials in a small amount.

DESCRIPTION OF THE PREFERRED EMBODIMENT

According to the present invention, a support for electrophotography or electrostatic recording material is provided by the first step which comprises fixing (A) an anionic sizing agent into a layer of an untreated paper substrate by screening, size pressing, tube sizing or impregnation and the second step which comprises fixing (B) a cationic high polymer electroconducting agent into thus treated paper in the same manner as mentioned above or coating the same thereon.

Examples of the anionic sizing agents (A) which are commercially easily available are BASOPLAST-100L (trade name for ammonium salt of copolymer of carboxyl groups prepared by Badische Anilin-Soda Fabrik AG), SCRIPSET-500 (trade name for sodium salt of styrene/maleic anhydride copolymer prepared by Monsanto Co., Ltd.), POLYMALON-353 (trade name for sodium salt of styrene/maleic anhydride copolymer prepared by Arakawa Rinsan K.K.), SIZEUP-411K (trade name for alkyd resins prepared by Arakawa Rinsan K.K.), Hamacoat S-No. 5 (trade name for petroleum resins prepared by Hamano Kogyo K.K.), Sansizer SA-501 (trade name for acrylic resins prepared by Sanyo Kasei K.K.), Polymerset-305 (trade name for polyacrylamides prepared by Arakawa Rinsan K.K.), VINYMER 25A (trade name for sodium salt of vinylacetate/maleic anhydride copolymer prepared by Arakawa Rinsan K.K.), POLYFAC OM (trade name for sodium salt of isobutene/maleic anhydride copolymer prepared by Nihon Yushi K.K.), etc. There is no limitation in selection of these anionic sizing agents, but use of sodium salts of styrene/maleic anhydride copolymer, vinylacetate/maleic anhydride copolymer and isobutene/maleic anhydride copolymer can provide conspicuous effect of the present invention and furthermore, these can be conventionally used in the usual paper making process. Therefore, these are especially excellent among those enumerated above.

As the cationic high polymer electroconducting agents (B), those which are of quaternary ammonium salt type such as polyvinylbenzyl trimethylammonium chloride disclosed in U.S. Pat. No. 3011918, etc., may be used. As commercially available products, ECR-34 (trade name for the product of Dow Chemical Co., Ltd.), Chemistat-6200 (trade name for the product of Sanyo Kasei K.K.), PQ-1OW-2 (trade name for the product of Soken Kagaku K.K.), MCP 16 (trade name for the product of Kyoei K.K.), etc., may be used.

These materials (A) and (B) may be used singly or jointly at respective steps.

According to the present invention, excellent electroconductivity can be obtained by application of the electroconducting agent (B) in a small amount. This is attributable to the fact that the electroconducting agent (B) has no compatibility with the sizing agent (A) which can provide solvent resistance to a support. On the contrary, when a solvent resistance imparting agent which has compatibility with the electroconducting agent is blended with or coated on the electroconducting agent, the electroconductivity of the support is greatly decreased. This is considered due to the fact that the electroconducting agent (B) is not in the form of a continuous layer.

It has now become clear by comparative examinations of various materials that the anionic sizing agents as enumerated above as typical examples have remarkable effect in that they have solvent resistance with a small application amount while maintaining the excellent efficiency of the cationic high polymer electroconducting agent.

The characteristic of the present invention resides in that the use of the cationic high polymer electroconducting agent in the second step in combination with the use of the anionic sizing agent in the first step can result in the following effects.

1. Solvent resistance of the support becomes higher than that of a support subjected to only the treatment of the first step.

2. Electroconductivity of the support becomes higher than that of a support subjected to only the treatment of the second step.

3. By filling the inside of the support and coating the surface of the support with compositions containing ionic materials and free salts, electrophotographically and electrostatically recorded image which is much superior to image obtained by using a support subjected to only either the first step or the second step can be obtained.

Reasons why such unexpected results can be obtained are not clear, but it is presumed that an ion cross linking reaction takes place at the interface between the anionic sizing agent and the cationic high polymer electroconducting agent which have no compatibility with each other and which are superposed with each other, thereby to form a uniform film having solvent resistance and since the two agents are both ionic materials and have water holding property and free pair ions, they have a synergistic effect for improving the electroconductivity.

In the method of the present invention, other water soluble resins, emulsions and amines in a necessary minimum amount may be used in combination with the cationic high polymer electroconducting agent in the second step for preventing flocking, curling and discoloring and fading of the recording layer.

The first and second steps of the present invention may be carried out in a continuous on-machine system or off-machine system in the usual paper making step and paper finishing step. The positions of the first and second steps of the present method have no limitation.

According to the method of the present invention explained above, a light support for electrophotography and electrostatic recording which is excellent in solvent resistance and electroconductivity can be obtained with application of said agents in a total dried weight of 0.5 to 6.0 g/m$^2$.

Amount of the agents to be applied depends mainly upon solvent resistance and electroconductivity of support. When satisfactory solvent resistance is attained with the anionic sizing agents (A) having high synergistic effect with the cationic high polymer electroconducting agents at the first step, an excellent electroconductive continuous layer can be formed with application of the electroconducting agent in a small amount at the second step. Therefore, from practical and economical viewpoint, 0.4 – 3.0 g/m$^2$ of the anionic sizing agent is applied at the first step and 0.1 – 5.0 g/m$^2$ of the cationic electroconducting agent is applied at the second step.

The present invention will be illustrated in the following Examples.

EXAMPLE 1

A coating liquid comprising 5 parts of sodium salt of anionic styrene/maleic anhydride copolymer (SCRIPSET-500 of Monsanto Co.) and 95 parts of water was size pressed in an amount of 25 g/m$^2$ (including water) into an untreated paper having a basis weight of 45 g/m$^2$ produced by screening a pulp comprising 100 parts of pulp, 1 part of melamine resin and 3 parts of aluminum sulfate into a paper and thus treated paper was dried. Thereafter, a coating liquid comprising 5 parts of a cationic quaternary ammonium salt type high polymer electroconducting agent (Chemistat-6200) and 95 parts of water was coated on both sides of said treated paper in an amount of 15 g/m$^2$ per one side (including water) with an air knife coater to obtain a base paper for electrophotographic and electrostatic recording having a basis weight of 48 g/m$^2$.

On thus obtained base paper was coated the known electrophotographic photosensitive coating liquid comprising zinc oxide, an insulating resin, sensitizing dye and an organic solvent in a dried weight of 20 g/m$^2$.

Thus obtained electrophotographic photosensitive paper had an extremely smooth surface, was considerably lighter in weight than the conventional electrophotographic paper which used zinc oxide, formed an image excellent in density and contrast in a wide humidity range and caused extremely little deteriorations due to pre-exposure such as reduction in image density, increase in fog, etc., usually caused when a photosensitive paper before use was exposed to strong white light for a long time.

When said base paper was coated with a known electrostatic recording liquid comprising an insulating resin, a matting agent, a pigment and an organic solvent in a dried weight of 5 g/m$^2$, thus obtained electrostatic recording paper had a smooth surface and produced an excellent image having high density and caused little stain of ground.

EXAMPLE 2

A coating liquid comprising 5 parts of anionic acrylic sizing agent (Sansizer SA-501 of Sanyo Kasei K.K.) and 95 parts of water was size pressed in an amount of 20 g/m$^2$ (including water) into an untreated paper which had a basis weight of 50 g/m$^2$ and which was produced by screening a pulp comprising 100 parts of pulp, 5 parts of said sizing agent and 1 part of aluminum sulfate at the paper making process and this was dried. Thereafter, a coating liquid comprising 5 parts of cationic quaternary ammonium salt type high polymer electroconducting agent (ECR-34 of Dow Chemical Co., Ltd.) and 95 parts of water was coated on both sides of said treated paper in an amount of 30 g/m$^2$ (total of both sides) including water and was dried to obtain a base paper having a basis weight of 53 g/m$^2$.

To the resultant base paper was applied an electrophotographic photosensitive layer and an electrostatic recording layer, respectively, in the same manner as in Example 1.

Thus obtained electrophotographic paper and electrostatic recording paper were both extremely excellent as those obtained in Example 1.

EXAMPLE 3

Both sides of the paper size pressed with the anionic sizing agent as in Example 1 were coated with a coating liquid having the following compositions in an amount of 7.5 g/m² (including water) per one side to obtain a base paper having a basis weight of 52 g/m².

| | |
|---|---|
| Clay | 10 parts |
| Vinyl acetate emulsion (MOVINYL 565 produced by Hoechst Gosei K.K.) | 10 parts |
| Cationic quanternary ammonium salt type high polymer electroconducting agent (MCP-16 produced by Kyoei K.K.) [Homopolymer or copolymer of a monomer having the following general formula: | |

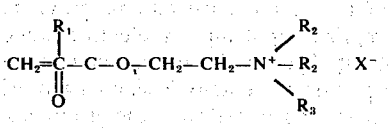

(wherein $R_1$: methyl, $R_2$: methyl, $R_3$: β-hydroxyethyl and X: chlorine)] 10 parts
Hexamethylenetetramine 0.5 part
Water 70 parts Thus obtained base paper was coated with electrophotographic photosensitive layer and electrostatic recording layer, respectively.

Thus obtained recording papers both had extremely excellent surface and formed extremely excellent image and caused little curling and flocking in a wide humidity range as in Examples 1 and 2. Thus, applicability to practical copying machine is greatly increased.

Furthermore, in case of the electrophotographic paper, change in sensitivity with lapse of time and discoloration and fading of the photosensitive layer were conspicuously decreased.

COMPARATIVE EXAMPLE 1

A coating liquid comprising 2 parts of polyvinyl alcohol, 3 parts of oxidized starch and 95 parts of water was size pressed in an amount of 25 g/m² (including water) into an untreated paper produced in the same manner as in Example 1 and dried. Thereafter, to thus coated paper was coated the same cationic high polymer electroconducting agent in the same manner and in the same amount as in Example 1 to obtain a base paper.

To thus obtained base papers were applied the electrophotographic photosensitive layer and electrostatic recording layer in the same manner as in Examples 1, 2 and 3.

Since the solvent resistances of said base papers were extremely low, the recording papers thus obtained had rough surface and did not produce good image and when liquid developing process was applied, a large amount of developer penetrated into the paper from both sides and when dry developing process with tonor was employed, extreme stain of the ground with tonor was caused and such recording paper cannot be practically used.

In case of this Comparative Example, when the cationic high polymer electroconducting agent was coated in an extremely large amount, the coating surface becomes relatively smooth, but cost for production is increased and moreover curling, flocking, etc., are increased.

COMPARATIVE EXAMPLE 2

On the papers prepared and subjected to size pressing in the same manner as in Example 2 were coated a coating liquid comprising 5 parts of anionic styrene/maleic anhydride copolymer sodium salt (POLYMALON 353 produced by Arakawa Rinsan K.K.) and 95 parts of water in the same amount and in the same manner as in Example 2 and they were dried. Thereafter, the same electrophotographic photosensitive layer and electrostatic recording layer as in the preceding Examples were provided on said papers.

Thus obtained two recording papers had smooth surface similar to those obtained in Examples 1 and 2, but such phenomena as reduction in density of image, base fog, stain of back side, deterioration due to preexposure, etc., which are caused by insufficient electroconductivity markedly occurred in a low humidity area of less than 40 percent RH.

In this Comparative Example 2, said defects could not be markedly improved even when amount of the anionic sizing agent in the second step was increased.

The presentative characteristics in the above Examples and Comparative Examples are enumerated in the following Table to explain the effects of the present invention.

| | Treating methods and materials | | Surface resisting at 20°C, 40 % RH (Ω/ ) | | Solvent resistance | | | | |
|---|---|---|---|---|---|---|---|---|---|
| | The first step | The second step | The first step | The second step | The primary treatment | The secondary treatment | Smoothness of recording layer | Image quality at low humidity | Pre-exposure resistance |
| Example 1 | Size press Anionic sizing agent | Coating with air knife Quaternary ammonium salt | $7.3 \times 10^{10}$ | $3.2 \times 10^{7}$ | Δ | ○ | ○ | ○ | ○ |
| Example 2 | Screening Anionic sizing agent | Impregnation Quaternary ammonium salt | $4.9 \times 10^{11}$ | $6.4 \times 10^{7}$ | ⓐ | ○ | ○ | ○ | ○ |
| Example 3 | Same as in Example 1 | Blade coating. Mixture containing quaternary ammonium salt | $7.3 \times 10^{10}$ | $8.5 \times 10^{8}$ | Δ | ○ | ○ | ○ | ○ |
| Comparative Example | Size press Nonionic sizing | Same as in | $7.5 \times 10^{12}$ | $7.2 \times 10^{9}$ | × | × | × | × | × |

-continued

| | Treating methods and materials | | Surface resisting at 20°C, 40 % RH (Ω/ ) | | Solvent resistance | | Smoothness of recording layer | Image quality at low humidity | Pre-exposure resistance |
|---|---|---|---|---|---|---|---|---|---|
| | The first step | The second step | The first step | The second step | The primary treatment | The secondary treatment | | | |
| 1 | agent | Example 1 | | | | | | | |
| Comparative Example 2 | Same as Example 2 | Impregnation Anionic sizing agent | $4.9 \times 10^{11}$ | $9.3 \times 10^{10}$ | Ⓐ | ○ | ○ | × | × |

In the above Table, "○" = Good, "Ⓐ" = Somewhat inferior, "Δ" = Bad (The base paper may be used under limited conditions) and "×" = Extremely bad. The solvent resistance was determined in accordance with permeation of xylene.

What is claimed is:

1. In a method for producing a support for electrophotographic materials or electrostatic recording material which comprises applying an electroconducting agent to an untreated paper, the improvement comprising the first step of fixing an anionic sizing agent which is at least one member selected from the group consisting of a. sodium salts of maleic and derivative copolymers,
b. ammonium salts of copolymers containing carboxyl groups,
c. alkyd resin,
d. petroleum resin,
e. acrylic resin, and
f. polyacrylamide resin into a layer of the untreated paper and the second step of coating an electroconductive quaternary ammonium polymer on the thus treated paper.

2. A method according to claim 1, wherein the first step is accomplished by screening.

3. A method according to claim 1 wherein the total dried weight of the anionic sizing agent and the cationic high polymer electroconducting agent applied is 0.5 to 6.0 g/m$^2$.

4. A method according to claim 1 wherein the first step is accomplished by size pressing.

5. A method according to claim 1 wherein the first step is accomplished by tub sizing.

6. A method according to claim 1 wherein the first step is accomplished by impregnation.

7. A method according to claim 1 wherein said anionic sizing agent is a sodium salt of a maleic acid derivative copolymer, said copolymer being selected from the group consisting of (a) styrene-maleic anhydride copolymer, (b) vinyl acetate-maleic anhydride copolymer and (c) isobutene-maleic anhydride copolymer.

8. In a method for producing a support for electrophotographic materials or electrostatic recording material which comprises applying an electroconducting agent to an untreated paper, the improvement comprising the first step of fixing an anionic sizing agent which is at least one member selected from the group consisting of a. sodium salts of maleic and derivative copolymers,
b. ammonium salts of copolymers containing carboxyl groups,
c. alkyd resin,
d. petroleum resin,
e. acrylic resin, and
f. polyacrylamide resin into a layer of the untreated paper and the second step of fixing an electroconductive quaternary ammonium polymer into the thus treated paper.

9. A method according to claim 8 wherein said anionic sizing agent is a sodium salt of a maleic acid derivative copolymer, said copolymer being selected from the group consisting of (a) styrene-maleic anhydride copolymer, (b) vinyl acetate-maleic anhydride copolymer and (c) isobutene-maleic anhydride copolymer.

10. A method according to claim 8 wherein the first step is accomplished by screening.

11. A method according to claim 8 wherein the first step is accomplished by size pressing.

12. A method according to claim 8 wherein the first step is accomplished by tub sizing.

13. A method according to claim 8 wherein the first step is accomplished by impregnation.

14. A method according to claim 8 wherein the total dried weight of the anionic sizing agent and the cationic high polymer electroconducting agent applied is 0.5 to 6.0 g/m$^2$.

* * * * *